United States Patent [19]

Günther et al.

[11] 4,366,911

[45] Jan. 4, 1983

[54] UNCOUPLING CENTRAL BUFFER COUPLINGS ON RAIL VEHICLES

[75] Inventors: Wilhelm Günther, Wolfenbuttel; Joachim Kreher, Brunswick, both of Fed. Rep. of Germany

[73] Assignee: Scharfenbergkupplung GmbH, Fed. Rep. of Germany

[21] Appl. No.: 157,545

[22] Filed: Jun. 9, 1980

[30] Foreign Application Priority Data

Jun. 8, 1979 [DE] Fed. Rep. of Germany ..... 2923195

[51] Int. Cl.[3] ..... B61G 3/016

[52] U.S. Cl. ..... 213/100 R; 213/77; 213/88

[58] Field of Search ..... 213/88, 77, 79, 78, 213/87, 89, 90, 96, 97, 98, 99, 100 R, 100 N, 104, 174, 175, 184, 190, 75 R, 75 GT, 88 R, 112, 119, 124, 132, 133, 137, 124; 74/89.14, 96; 292/201, 247

[56] References Cited

U.S. PATENT DOCUMENTS

| | | | |
|---|---|---|---|
| 2,777,688 | 1/1957 | Erlich et al. | 74/89.14 |
| 2,898,138 | 8/1959 | Van Noord | 292/201 X |

FOREIGN PATENT DOCUMENTS

| | | | |
|---|---|---|---|
| 675623 | 5/1939 | Fed. Rep. of Germany | 213/100 R |
| 906342 | 9/1954 | Fed. Rep. of Germany | 213/97 |
| 96725 | 9/1939 | Sweden | 213/90 |

*Primary Examiner*—Joseph F. Peters, Jr.
*Assistant Examiner*—M. J. Hill
*Attorney, Agent, or Firm*—McGlew and Tuttle

[57] ABSTRACT

A device for uncoupling central buffer couplings on rail vehicles having a rotatable disk hook includes a cam operatively connected to a worm wheel for rotation therewith which, in turn, is connected to an electric motor. The cam is rotatably operative to engage a bridge member connected to the disk hook in order to rotate the disk hook and also to engage a switch for energizing and de-energizing the motor.

5 Claims, 3 Drawing Figures

UNCOUPLING CENTRAL BUFFER COUPLINGS ON RAIL VEHICLES

FIELD AND BACKGROUND OF THE INVENTION

The invention relates to an uncoupling means for central buffer couplings on rail vehicles, whose coupling closure is composed of a rotatable disk hook with articulated coupling eye, and wherein an electric motor which controls the rotary movement of the disk hook via a worm wheel is provided as uncoupling means.

An uncoupling means for central buffer couplings is known, wherein the turning of the disk hook is effected through a push rod which is articulated eccentrically to the axis of rotation of the disk hook and eccentrically to the drive shaft of an electric motor. Such an arrangement, however, is possible only with so-called two-position couplings, i.e., couplings where the disk hook of the coupling closure occupies a different position in the coupled and uncoupled states, so that the coupling eye lies either outside of or in the cone.

SUMMARY OF THE INVENTION

It is the object of the invention to provide an uncoupling means of the above mentioned kind for so-called single position couplings, that is, couplings where the disk hook of the coupling closure occupies the same position both in the coupled and the uncoupled state.

Accordingly, it is an object of the invention to provide a device for uncoupling central buffer couplings on rail vehicles of the type having a rotatable disk hook with an articulated coupling eye which includes an elongated bridge piece fixedly connected at one end to the disk hook and having parallel spaced prongs at the opposite end. A housing is provided in which an electric motor is mounted. Switch means are provided for energizing and de-energizing the electric motor. Cam means are rotatably mounted to the housing for engaging the prongs to impart rotation to the disk hook and for engaging the switch means to energize or de-energize the electric motor. The electric motor and the cam means are interconnected so that when the motor is energized the cam means rotates relative to the housing. In accordance with a preferred embodiment of the invention, the electric motor has a worm shaft and the cam means includes a cam shaft mounted to the housing, a worm wheel mounted on the cam shaft for rotation relative to the housing, a cam plate, a hub fixedly connected to the worm wheel having a plate portion overlying the worm wheel and an extension portion supporting the cam plate at spaced location from the plate portion, and two rollers mounted intermediate the cam plate and the plate portion of the hub. The worm shaft is interconnected with the worm wheel.

According to the invention, this problem is solved in that the disk hook is connected with a fork type bridgepiece and the worm wheel carries a hub and a cam plate connected therewith, the hub being in operative connection with the disk hook through the bridgepiece, and the limit switch for the electric motor being actuated via the cam plate.

It is a further object of the invention to provide a device for uncoupling control buffer couplings on rail vehicles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 3:
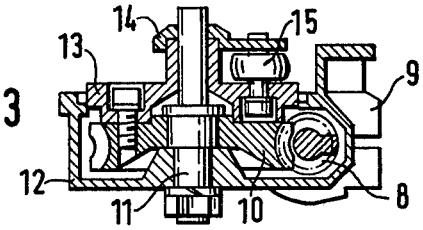
FIG. 3 is a section taken along line III—III of FIG. 1.

Referring to the drawings in particular, there is shown a preferred embodiment of a device for uncoupling central buffer couplings on rail vehicles.

The mechanical coupling closure consists in known manner of the disk hook 1 with articulated coupling eye 2, which hook is fastened to the main bolt 3 mounted in the coupling head housing. To the main bolt 3, there is further fastened an elongated bridgepiece 4, whose free end is formed in fork from by the two parallel spaced prongs 5 and 6, prongs 5 and 6 engaging into the zone of the uncoupling means.

The uncoupling means is composed of an electric motor 7, having an associated worm shaft 8, mounted in a housing 9. Worm shaft 8 engages a worm wheel 10 mounted, for rotation, about a cam shaft or bolt 11 which is fastened in a housing 12 and extends parallel to the main bolt 3. The vertical median planes through the main bolt 3 and bolt 11 are offset to each other. On worm wheel 10, a hub 13 is fastened which carries in spaced relation a cam plate 14. Hub 13 and cam plate 14 are firmly connected together and rotatable about the bolt 11. Rollers 15 are mounted between hub 13 and cam plate 14. A toggle switch 16 bears against cam plate 14 in the coupled state of the central buffer coupling. The toggle switch 16 is connected to a limit switch 17 which, in turn, is connected with the electric motor 7.

Figure 1:
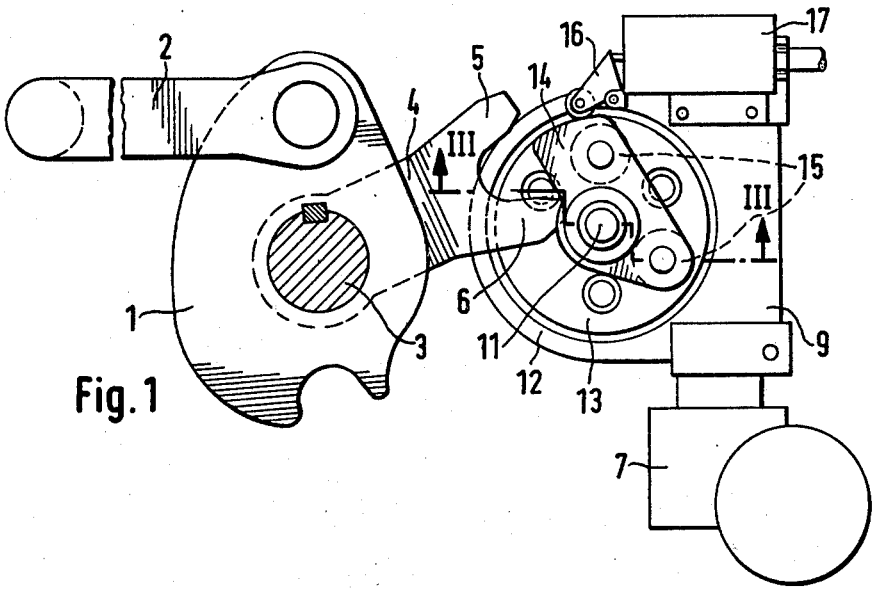
FIG. 1 shows, in top view, the uncoupling means in the coupled state of the central buffer coupling.
Figure 2:
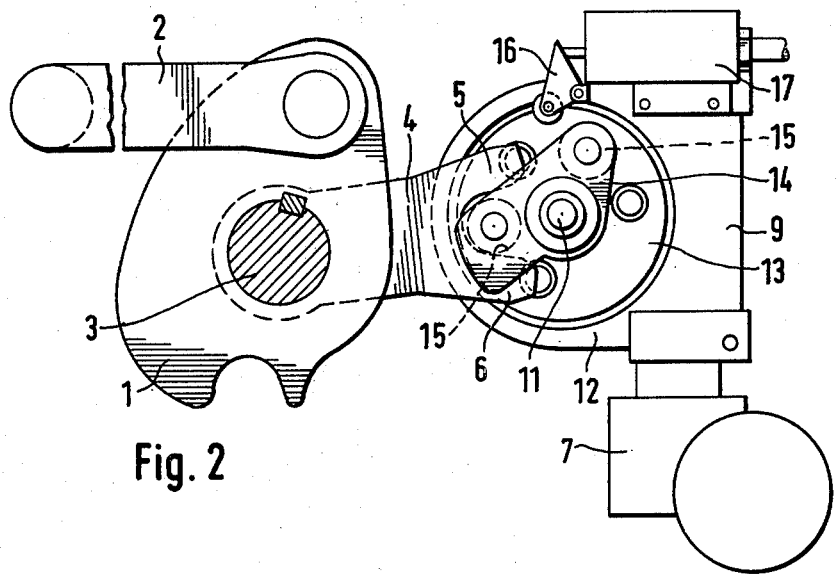
FIG. 2 shows the uncoupling means during uncoupling.

For uncoupling, a pulse is given manually from the engineer's cab for actuation of motor 7. Through motor 7 and the connected worm shaft 8 the worm wheel 10 is rotated. Due to the fact that both the hub 13 and the cam plate 14 are firmly connected with the worm wheel 10, they too are rotated counterclockwise relative to the view of FIGS. 1 and 2. As soon as cam plate 14 is out of the zone of toggle switch 16, the latter switches the limit switch 17 on and the pulse for the electric motor 7 is now passed on through the limit switch 17. After a certain broad further rotation of hub 13, roller 15 engages and rotating prong 6 with bridgepiece 4 and, since the latter is connected with the main bolt 3 carrying the disk hook 1, also the disk hook 1 is rotated clockwise, that is, contrary to the direction of rotation of hub 13. After a further rotary movement, a second roller 15 now engages prong 5 and continues to execute the rotary movement of the disk hook 1. After prongs 5 and 6 are out of engagement with the rollers 15, the coupling is uncoupled and the mechanical coupling closure is brought back into its starting position by a spring (not shown). The uncoupling means continues to run until cam plate 14 strikes against toggle switch 16 and thus switches the electric motor 7 off again via the limit switch 17.

While a specific embodiment of the invention has been shown and described in detail to illustrate the application of the principles of the invention, it will be understood that the invention may be embodied otherwise without departing from such principles.

We claim:

1. A device for uncoupling a central buffer coupling on a rail vehicle of the type having a rotatable disk hook with an articulated coupling eye, comprising an elongated bridgepiece fixedly connected at one end thereof to the disk hook and having spaced prongs at an opposite end thereof, a housing, an electric motor mounted to said housing, switch means for energizing and de-energizing said electric motor, cam means rotatably mounted to said housing for engaging said prongs to impart rotation to the disk hook and for engaging said switch means to energize and de-energize said electric motor, said electric motor and said cam means being interconnected so that when said motor is energized, said cam means rotates relative to said housing, said motor having a worm shaft and said cam means including a worm wheel mounted to said housing for rotation relative to said housing and a cam plate fixedly connected to said worm wheel and engageable with said switch means.

2. A device according to claim 1, wherein said cam means further includes a cam shaft rotatably mounted to said housing and connected to said worm wheel and cam plate, a hub connected between said worm wheel and cam plate having a plate portion overlying said worm wheel and an extension portion supporting said cam plate at a spaced location from said cam plate, and two rollers mounted between said cam plate and said plate portion of said hub, said worm shaft interconnected with said worm wheel for rotation of said worm wheel when said motor is energized, one of said rollers being movable into a position between two prongs of said bridgepiece and the other of said rollers being engageable with one of said prongs during rotation of said cam shaft to rotate said bridgepiece and the disk hook.

3. A device as set forth in claim 2, wherein said switch means includes a toggle rotatably mounted to said housing and a switch engageable by said toggle and connected to said motor for energizing and de-energizing said motor, said toggle having a portion extending into a path of said cam plate so that said cam plate moves said toggle to energize and de-energize said motor with movement of said cam plate.

4. A device as set forth in claim 2 further comprising a bolt member fixedly connecting said bridgepiece to the disk hook, said bolt member being disposed parallel to said cam shaft, and said bolt member and said cam shaft lying in separate vertical planes that are parallel and offset relative to each other.

5. A device as set forth in claim 2 wherein said hub and said cam plate are mounted for rotation about said cam shaft.

* * * * *